US007857076B2

(12) United States Patent
Bui et al.

(10) Patent No.: US 7,857,076 B2
(45) Date of Patent: Dec. 28, 2010

(54) FORCE BALANCING SYSTEM FOR USE WITH A WELL BORE TOOL

(75) Inventors: Huy D. Bui, Houston, TX (US); Brooks Howard Javins, Morgantown, WV (US); Kenneth Wayne Ahlhorn, Cypress, TX (US)

(73) Assignee: Javins Corporation, Morgantown, WV (US)

( * ) Notice: Subject to any disclaimer, the term of this patent is extended or adjusted under 35 U.S.C. 154(b) by 81 days.

(21) Appl. No.: 12/111,772

(22) Filed: Apr. 29, 2008

(65) Prior Publication Data

US 2009/0266613 A1 Oct. 29, 2009

(51) Int. Cl.
*E21B 4/14* (2006.01)

(52) U.S. Cl. ..... 175/57; 175/296

(58) Field of Classification Search ..... 175/296, 175/65, 298, 293

See application file for complete search history.

(56) References Cited

U.S. PATENT DOCUMENTS 3,388,636 A * 6/1968 Collier ..... 91/234
3,612,191 A * 10/1971 Martini ..... 173/73
3,827,294 A 8/1974 Anderson
3,855,853 A 12/1974 Claycomb
4,901,806 A 2/1990 Forrest
5,305,837 A 4/1994 Johns et al.
5,322,136 A 6/1994 Bui et al.
RE36,166 E 3/1999 Johns et al.
RE36,848 E 9/2000 Bui et al.
6,427,788 B1 8/2002 Rauchenstein
2007/0089908 A1 * 4/2007 Underwood ..... 175/57

OTHER PUBLICATIONS

PCT Search Report for International Application No. PCT/US2009/042073 dated Feb. 2, 2010.

* cited by examiner

*Primary Examiner*—David J Bagnell
*Assistant Examiner*—Elizabeth C Gottlieb
(74) *Attorney, Agent, or Firm*—Patterson & Sheridan, LLP

(57) ABSTRACT

A force balancing system for use with a well bore tool, such as a drilling tool, is provided. The tool may be connected to a drill string, and the force balancing system is adapted to decouple the weight of the drill string from the operation of the tool. The force balancing system utilizes hydraulic or pneumatic pressure to advance the tool into the well bore, while preventing excessive weight from being applied to the tool.

37 Claims, 4 Drawing Sheets

FORCE BALANCING SYSTEM FOR USE WITH A WELL BORE TOOL

BACKGROUND OF THE INVENTION

1. Field of the Invention

Embodiments of the present invention generally relate to a system for use with a well bore tool. Particularly, embodiments of the present invention relate to a force balancing system that decouples the weight of the drill string from the operation and advancement of the tool within a well bore.

2. Description of the Related Art

A percussion method of drilling a well bore into an earthen formation, especially hard rock, involves a cyclic and a spike-like impacting force rather than a steady pressing force imposed by the weight of the drill string. This percussive action produces a superior high rate of penetration versus the traditional drill-by-weight method.

In a percussion drilling application, the drill head needs to be rotated, not for the purpose of delivering energy to break the rock, but rather, for the purpose of positioning the cutting elements mounted on its face to come into contact with fresh rock formations during each subsequent strike. Traditionally, this need is achieved by keying the drill head to the drill string so that the rotation of the drill string, provided by a rotary table mounted on the rig, and in the range of 20 to 40 rpm, is transferred to the drill head.

Usually, percussion drilling tools are pneumatic devices connected to the end of a drill string. Highly compressed air is directed alternately into and out of two separate chambers. One chamber is positioned above a sliding body, commonly known as a piston, and the other chamber is positioned below the sliding body so that the air causes the body to accelerate up and down, reciprocating within the tool housing. During the tool operation, the drill head is kept in contact with the earth at the bottom of a well bore. As the sliding body is directed downward, it forcefully strikes the top of the drill head and causes the rock contacting the drill head to disintegrate.

In a conventional drill-by weight method, the force that is used to press the drill head against the bottom of the formation, commonly called weight-on-bit, is typically between 20,000 to 50,000 pounds. In percussion drilling, since it is the impact force of the reciprocating piston against the drill head that breaks up the formation, this immense weight-on-bit is not needed. However, as the drill head penetrates the formation, it tends to slide out of the housing of the tool. If the drill string is not allowed to descend into the well bore quick enough to keep up with the drill head progression into the formation, the tool can enter into an "opening position" and stop cycling.

On the contrary, however, if the weight of the drill string is not held back properly, the drill string can apply excessive weight onto the drill head. This is also undesirable since the extreme weight-on-bit dramatically increases the frictional torque necessary to rotate the drill head, resulting in excessive damages to related components. The operator thus faces the difficult task of advancing the drill string, on the one hand, quick enough to prevent the tool from opening, and on the other hand, slow enough to avoid pressing the drill head too hard against the formation. This is especially difficult since the operator must hold back most, but not all, of the drill string weight, yet strives to allow gravity to apply just enough force to keep the tool closed. Frictional drag created by contact between the drill string and the walls of the well bore exacerbates this dilemma.

Therefore, there is a need for a methodical system to balance the weight of the drill string and its advancement into the well bore.

SUMMARY OF THE INVENTION

The present invention generally relates to a percussion drilling tool. In one aspect, a system for use with a well bore tool is provided. The well bore tool includes a first sub connected to a drill string at an upper end of the sub, a second sub connected to a lower end of the first sub, and a cylindrical housing connected to the second sub, wherein the first sub is adapted to slideably engage with the second sub, and wherein the weight of the drill string is decoupled from the well bore tool.

In another aspect, a force balancing system is provided. The force balancing system includes a well bore tool connected to a drill string, the tool comprising a cylindrical housing connected to a sub-assembly, and a first chamber and a second chamber disposed within the housing, wherein when the first and second chambers are pressurized, the weight of the drill string is decoupled from the tool.

In another aspect, a method of balancing the weight of a drill string and a well bore tool is provided. The method includes the steps of directing the well bore tool on the drill string into a well bore, pressurizing a first chamber and a second chamber disposed in the well bore tool, and decoupling the weight of the drill string from the well bore tool.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to an apparatus and method of controlling the weight of a drill string while utilizing a well bore tool in a well bore. As set forth herein, the invention will be described as it relates to a percussion drilling tool. It is to be noted, however, that aspects of the present invention are not limited to use with a percussion drilling tool, but are equally applicable to use with other types of well bore tools. To better understand the novelty of the apparatus of the present invention and the methods of use thereof, reference is hereafter made to the accompanying drawings.

Figure 1:
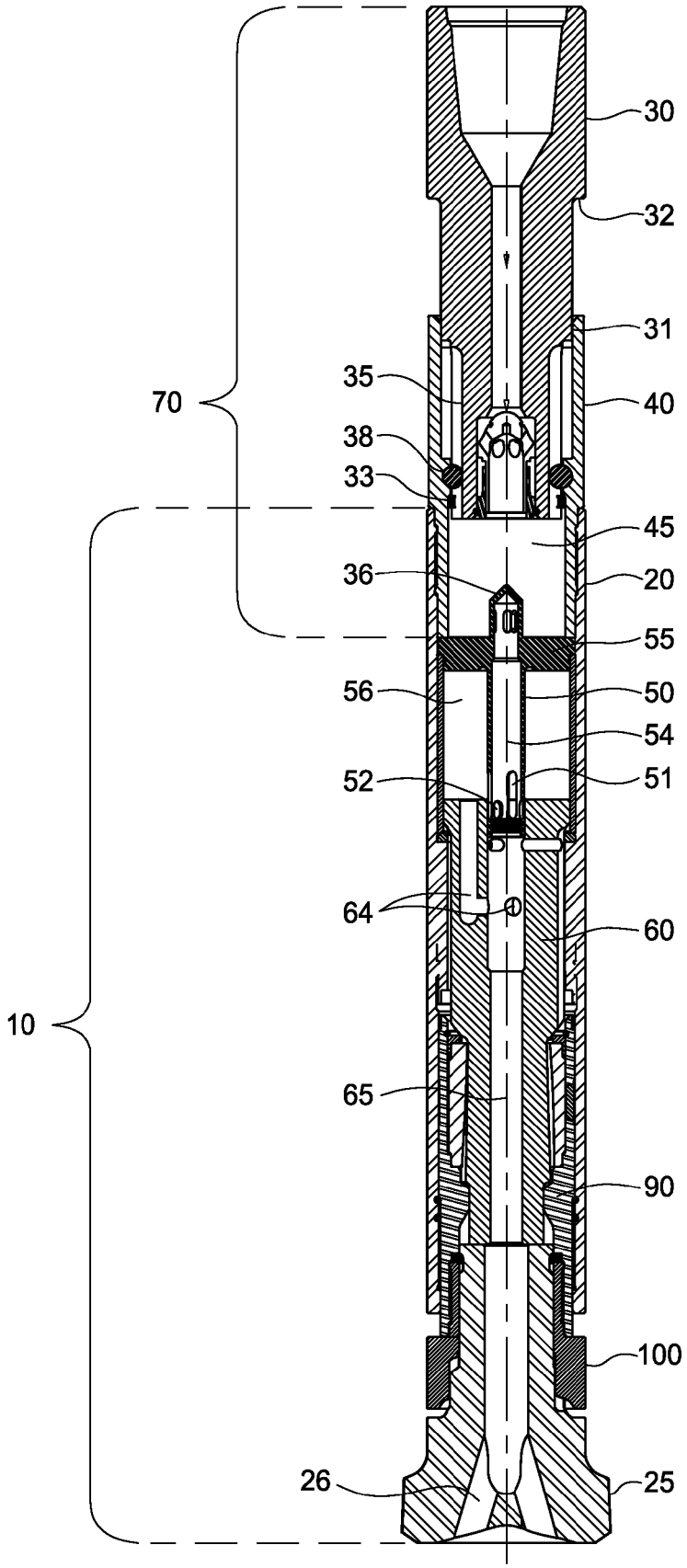
FIG. 1 is a sectional view of a force balancing system in a fully open position and a drilling tool in a flushing mode.
Figure 2:
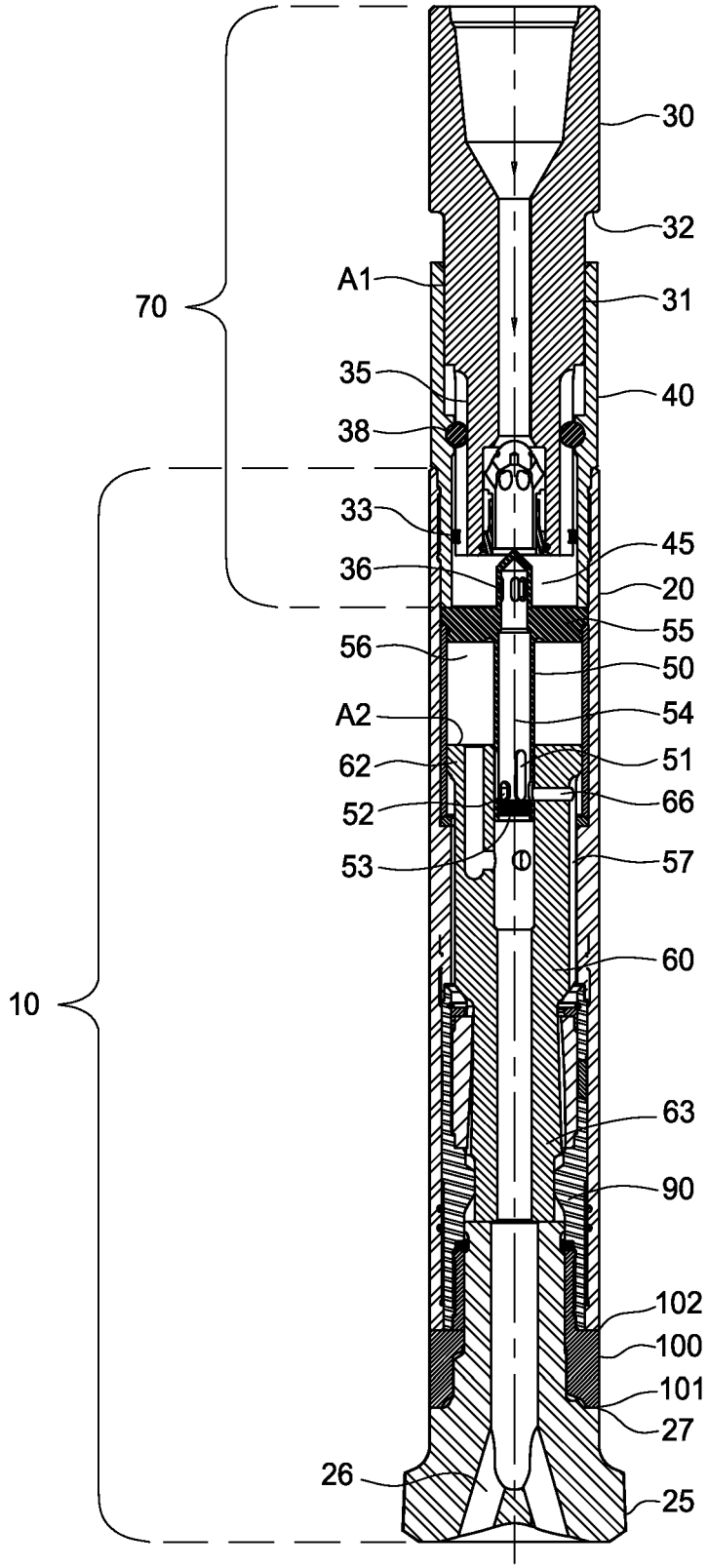
FIG. 2 is a sectional view of the force balance system in a balanced position and the drilling tool at the beginning of the upstroke of a piston.
Figure 3:
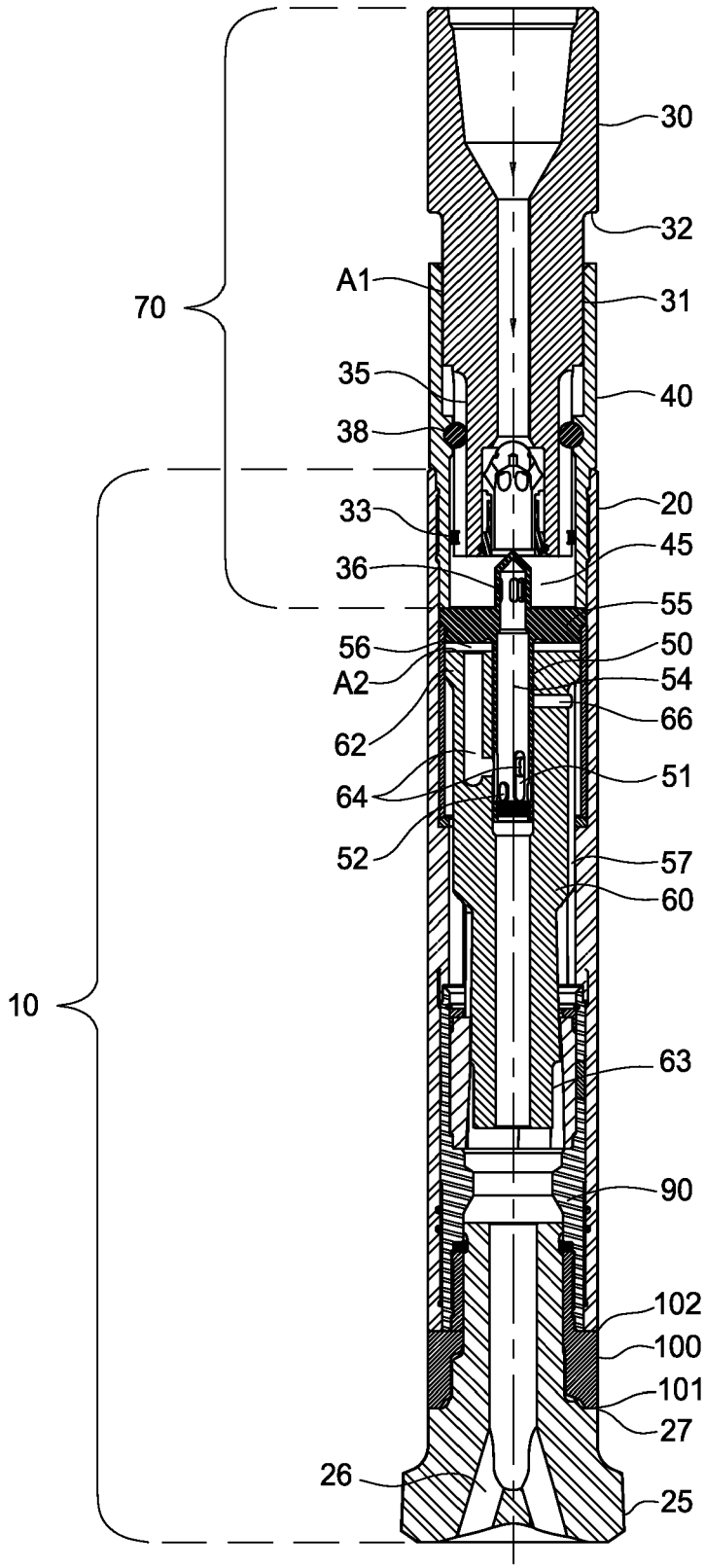
FIG. 3 is a sectional view of the force balance system in the balanced position and the drilling tool at the beginning of the down stroke of the piston.

FIGS. 1-3 will be briefly discussed to provide a general overview of the operation of a percussion drilling tool and a method of percussion drilling. As a percussion drilling tool is hung off bottom in a well bore by a drill string, pressurized air is directed down the drill string through and by-passing the drilling tool into the well bore. This is known as a "flushing" mode, and it helps remove rock chips and other debris at the bottom of the well bore. When the tool lands at the bottom of the well bore, a drill head is positioned into a "closed" mode and operation of the tool begins. During operation, a piston body begins to reciprocate within the tool housing and impacts the top of the drill head, fragmenting the adjacent rock formation below the drill head.

FIG. 1 shows the "flushing" mode of a drilling tool 10, as the tool is hung off bottom. A cutting assembly 25, one example of which will be referred to herein as a drill head 25, is suspended from a retaining sleeve 100, and both are partially disposed within a cylindrical body or housing 20. Prior to landing the drill head 25 against the bottom of the well bore, pressurized air may be directed down the drill string through a force balancing system 70 and into a feed tube chamber 54 of a feed tube 50. The air may then be directed through one or more openings 51 of the feed tube 50 into an upper chamber 56 and from there to an internal piston chamber 65 via channel 64. The internal piston chamber 65 is located in a piston 60. The air may be directed out through one or more openings 26 formed in the drill head 25. The pressurized air helps remove any debris that accumulates near the bottom of the well bore. Finally, the gap between the lower end of the housing 20 and the retaining sleeve 100 is called the "hammer drop," and the gap between the lower end of the retaining sleeve 100 and the drill head 25 is called the "bit drop." Both of these gaps are open during the flushing mode operation of the tool.

FIG. 2 shows the "closed" mode of the drilling tool 10 after it is lowered down the well bore and the drill head 25 contacts the bottom of the well. At this point, the "hammer drop" and "bit drop" are closed. Specifically, the drill head 25 and the retaining sleeve 100 are pushed into the housing 20 until a shoulder 27 formed by the drill head contacts a first shoulder 101 of the retaining sleeve 100 and a second shoulder 102 of the retaining sleeve 100 contacts the end of the housing 20. Upon contact, the piston 60 is pushed upward so that the air to the upper chamber 56 is shut off as an upper section 62 of the piston 60 covers the openings 51 of the feed tube 50. The air, in turn, is redirected through one or more openings 52 of the feed tube 50 into a lower chamber 57 via slot 66. A lower end 63 of the piston 60 engages with and seals against the bore of a drive shaft 90 so that as the lower chamber 57 is charged, the force of the built up pressure will accelerate the piston up the housing 20. This begins the reciprocation of the piston 60 and the operation of the drilling tool.

FIG. 3 shows the piston 60 at the top of its travel. As the piston 60 is accelerated upward, the sealed engagement between the lower end 63 of the piston 60 and the drive shaft 90 is released and the air from the lower chamber 57 is discharged through the openings 26 in the drill head 25. Thereafter, the pressurized air in the feed tube 50 is then redirected through the openings 51 to the upper chamber 56 via channel 64 to pressurize this chamber and decelerates the piston 60 until it comes to a stop, then accelerates it downward so that the lower end 63 of the piston impacts the top of the drill head 25.

Such a drilling tool 10, together with a bend sub (not shown) placed above and near the drill head, may allow the driller to maintain the orientation of the bend in the desired direction, thus enabling the well bore to be drilled directionally and percussively. The drilling tool 10 may achieve a build rate, or dog leg severity, of 5 degrees to 15 degrees per 100 feet in conjunction with bend subs of ½ degree to 2 degrees bend angles.

Aside from this general operation of the percussion drilling tool 10, referring to FIG. 2, the force balancing system 70 may be utilized to address the equilibrium necessary to effectively direct the drilling tool 10 into the well bore without unnecessarily applying an excessive weight-on-bit force. The force balancing system 70 may be employed to de-couple the weight of the drill string from the drilling tool 10 so that the drill head 25 is not excessively jammed into the bottom of the well formation, but instead remains in steady contact. The system may also remove the element of gravity from the operation of the drilling tool 10 so that it is fully operational in a vertical, angled, and/or horizontal drilling trajectory.

FIG. 2 shows the force balancing system 70 in a balanced position. In general, a force balance chamber 45 is filled with pressurized air that effectively pushes a mandrel sub 30 and the housing 20 in opposite directions, relieving the weight of the drill string on the drill head 25 and seating the drill head at the bottom of the well bore so that it remains in a closed, operating position. As long as the mandrel sub 30 is not in a fully inserted position, an optimum force on the drill head 25 may be maintained.

The force balancing system 70 includes a force balance housing 40, the force balance chamber 45, the mandrel sub 30, a valve 36, and one or more keys 38. The mandrel sub 30 is adapted to connect to a drill string (not shown) at its upper end and is movably attached to the force balance housing 40 at its lower end. A section 31 of the mandrel sub 30 is sealingly engaged with the inner diameter of the force balance housing 40. The lower end of the mandrel sub 30 is disposed within the force balance housing 40 and is moveably engaged with the inner diameter of the force balance housing 40 along the key 38. Finally, the lower end of the force balance housing 40 is connected to the upper end of the housing 20.

The key 38 is positioned between the mandrel sub 30 and the force balance housing 40, so that it is axially stationary with respect to the force balance housing 40 but travels within a race 35 along the lower end of the mandrel sub 30. The distance of travel can be any length from a few inches to a few feet. The key 38 facilitates the axial movement of the mandrel sub 30 relative the force balance housing 40 and prevents rotation between the two subs. In one embodiment, the key 38 includes a pin (not shown) disposed between the mandrel sub 30 and the force balance housing 40. The pin may be operable to increase the contact area between the pin and subs to reduce any stress experienced by the components upon relative movement between the components.

The race 35 on the mandrel sub 30 may be formed through to the end of the mandrel sub 30, and a snap ring 33 disposed around the lower end of the mandrel sub 30 may be used to limit the mandrel sub 30 axial stroke in one direction. The snap ring 33 may be adapted to engage a shoulder of the force balance housing 40 located below the key 38 to limit the travel of the mandrel sub 30 and to prevent the removal of the mandrel sub 30 from the force balance housing 40 during operation (also shown in FIG. 1). The snap ring 33 may also facilitate ease of assembly of the force balance system 70. In an alternative embodiment, the ends of the race 35 on the mandrel sub 30 may be adapted to function as stops and prevent removal by contacting the key 38. In addition, a shoulder 32 of the mandrel sub 30 may help prevent the mandrel sub 30 from being completely received into the force balance housing 40 when it abuts the upper end of the force balance housing 40 (also shown in FIG. 4).

It is helpful to briefly recite a few features disposed below the force balancing system 70 that interact with its operation. The feed tube 50 is mounted at one end to a feed tube support 55 that is secured within the housing 20. The other end of the feed tube 50 is partially disposed within the internal bore of the piston 60, so that the piston 60 can slide along its exterior. The feed tube 50 includes the feed tube chamber 54 that communicates with the force balance chamber 45 and the upper chamber 56. The feed tube 50 also contains openings 51 and 52. A feed tube seal 53 closes off the end of the feed tube 50 just below the openings 51 and 52 and forms a seal with the internal bore of the piston 60.

Referring still to FIG. 2, the force balance chamber 45 has an effective area A1 that is fashioned within the interior of the force balance housing 40. At one end, the force balance chamber 45, and thus the effective area A1, is sealed from the ambiance at section 31 of the mandrel sub 30. At the opposite end, the force balance chamber 45, and thus the effective area A1, may be sealed at the force balance housing 40 and the feed tube support 55 interface, or alternatively at the force balance housing 40 and the housing 20 interface. In one embodiment, the force balance chamber 45 may be sealed at its lower end by a bottom (not shown) of the force balancing system 70, independent of the drilling tool 10. For example, the feed tube support 55 may be integral with the force balance housing 40.

The upper chamber 56, on the other hand, has an effective area A2 that is fashioned within the interior of the housing 20, which is sealed at one end by the bottom of the feed tube support 55 attached to the housing and at the other end by the top of the piston 60. As pressurized air is introduced into the upper chamber 56 and directs reciprocation of the piston 60, the pressure in the effective area A2 increases and decreases, with a maximum force directed on the bottom of the feed tube support 55 and on the top of the piston 60 when the piston is at its uppermost stroke (shown in FIG. 3). This maximum force will direct the feed tube support 55 and thus the housing 20 in an upwards direction and will direct the piston 60 in a downwards direction.

During operation, pressurized air is directed down the drill string, through the mandrel sub 30, filling the force balance chamber 45. When the force balance chamber 45 is pressurized, it simultaneously generates a force against the mandrel sub 30 and the top of the feed tube support 55, which is attached to the housing 20. In effect, this force pushes the mandrel sub 30 upward and the housing 20 downward. However, at the same time, the pressurized air is also directed to the upper chamber 56 through the feed tube 50. When the upper chamber 56 is pressurized, it also simultaneously generates a force against the bottom of the feed tube support 55, which is attached to the housing 20, and the top of the piston 60. In effect, this force pushes the housing 20 upward and the piston 60 downward. Therefore, there are two opposing forces against the feed tube support 55 that are directing the housing 20 upward and downward.

If the housing 20 is allowed to be directed upward, the drill head 25 may be forced into an open position by opening the "hammer drop" and "bit drop" gaps, which will stop the operation of the piston 60 and thus the drilling. Also, if the housing 20 is allowed to be directed upward so that the mandrel sub 30 is fully inserted and abuts the force balance housing 40, then the excessive weight of the drill string may be applied to the drill head 25 (via the force balance housing 40 and the housing 20) against the bottom of the well bore. Thus, the force directing the housing 20 downward should be greater than or equal to the force directing the housing 20 upward to prevent these potential situations.

Furthermore, the force directing the housing 20 downward can be calculated by multiplying the maximum pressure in the force balance chamber 45 with the effective area A1 of the force balance chamber 45. Similarly, the force directing the housing 20 upward can be calculated by multiplying the maximum pressure in the upper chamber 56 with the effective area A2 of the upper chamber 56. The maximum pressure in the upper chamber 56 may exceed the level of pressurized air that is directed into the force balancing system 70 and the drilling tool 10. This excessive level of pressure may be produced when the pressure in the upper chamber 56 experiences a surge as the kinetic energy of the upward moving piston 60 is converted into potential energy. FIG. 3 shows the piston 60 at the top of its travel, the moment at which the upper chamber 56 may experience a surge in pressure. This maximum pressure may exceed that of the pressure in the force balance chamber 45. Thus, in one embodiment, the effective area A1 of the force balance chamber 45 may be set greater than the effective area A2 of the upper chamber 56 so that the housing 20 will not be forced in an upward direction. Once this is achieved, and as long as the driller keeps the mandrel sub 30 from being fully inserted into the force balance housing 40, it is the pneumatic force, and not gravity, that keeps the drill head 25 in a closed position without excessively pressing it against the bottom of the well bore.

In an alternative embodiment, a combination of the downward force produced in the force balance chamber 45 and the weight of the force balance housing 40 may be utilized to resist the pressure in the upper chamber 56 from allowing the drilling tool 10 to transition into an open position. The weight of the force balance housing 40, which is coupled to the housing 20, may be increased to provide an additional resistance against the upward force applied to the housing 20 as the upper chamber 56 is pressurized. The weight of the force balance housing 40 may be controlled by the material of the force balance housing 40, the physical dimensions of the force balance housing 40, the addition of weights, such as a collar, to the force balance housing 40, combinations thereof, and/or a variety of other methods known in the art. The downward force produced in the force balance chamber 45 may similarly be controlled by the amount of pressurized air directed into the chamber and the physical dimensions used to fashion the effective area A1 of the chamber. By adjusting a combination of the parameters comprising the force balance housing 40 and the force balance chamber 45, the maximum pressure in the upper chamber 56 may be prohibited from forcing apart the housing 20 and the drill head 25. This combination of the force balance housing 40 and the force balance chamber 45 may maintain the drilling tool 10 in a closed position and prevent excessive weight from being applied onto the drill head 25.

Figure 4:
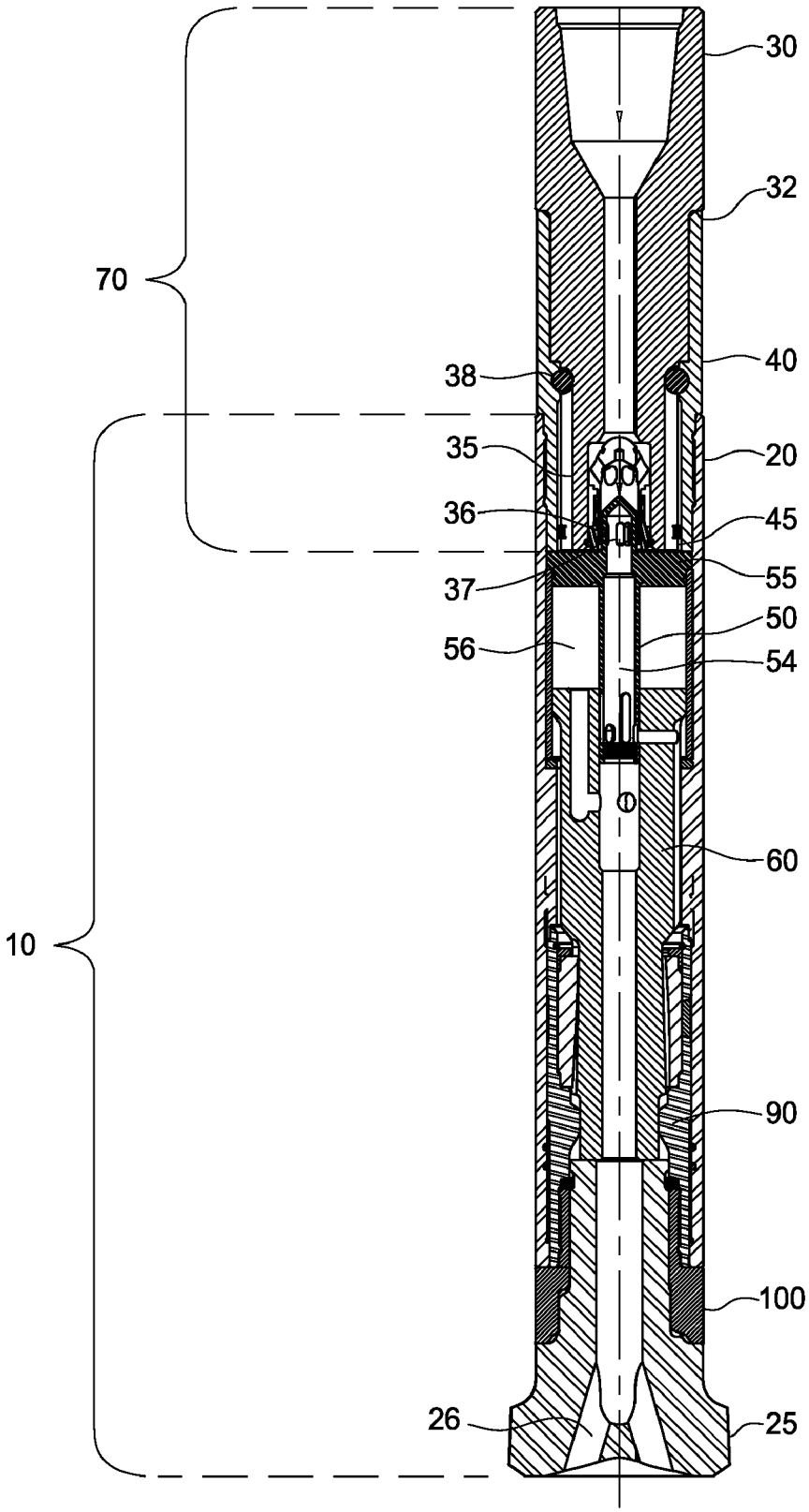
FIG. 4 is a sectional view of the force balancing system in a fully closed position.

Referring to FIG. 4, to assist the driller from being able to avoid fully inserting the mandrel sub 30, the valve 36 may be disposed above the feed tube support 55. As stated above, in one embodiment, the feed tube support 55 may be integral with the force balance housing 40 as the bottom of the force balancing system 70, thereby the valve 36 will be disposed on the bottom of the force balancing system 70 within the force balance chamber 45. The valve 36 may comprise a cylindrical housing with a cone shaped roof adapted to fit within the internal bore of the mandrel sub 30. The valve 36 may include windows 37, through which the pressurized air may be directed into the feed tube chamber 54 of the drilling tool 10. As the mandrel sub 30 approaches the fully inserted position, the internal bore of the mandrel sub 30 may begin to engage and enclose the valve 36. The walls of the internal bore of the mandrel sub 30 may surround windows 37 and inhibit the flow of the pressurized air traveling down the drill string through the force balance chamber 45 to the drilling tool 10. As the mandrel sub 30 beings to engage the valve 36, a rise in the pressure through the drill string and internal bore of the mandrel sub 30 can be communicated to the driller as a signal that the drill string should be raised up or backed off from the drilling tool. In the event that the mandrel sub 30 is fully inserted, the valve 36 may be completely enclosed within the mandrel and prohibit the flow of pressurized air to the force balance chamber 45 and the drilling tool 10, stopping the operation of the tool.

While the foregoing is directed to embodiments of the present invention, other and further embodiments of the invention may be devised without departing from the basic scope thereof, and the scope thereof is determined by the claims that follow.

The invention claimed is:

1. A method of using a force balancing system, the method comprising:

positioning a well bore tool in the well bore via a drill string, wherein the force balancing system is attached between the drill string and the well bore tool;

pressurizing a first chamber having a first effective area in the force balancing system and a second chamber having a second effective area in the well bore tool, wherein the first effective area is greater than the second effective area;

decoupling the weight of the drill string from the well bore tool; and reducing the pressurization of the second chamber when the weight of the drill string begins to move into engagement with the well bore tool.

2. The method of claim 1, further comprising ceasing pressurization of the first chamber and the second chamber when the weight of the drill string is applied to the well bore tool.

3. The method of claim 1, further comprising operating the well bore tool while relieving the weight of the drill string from the well bore tool.

4. The method of claim 1, further comprising advancing the well bore tool independent of the weight of the drill string as the well bore tool is penetrating a formation of the well bore.

5. The method of claim 1, wherein a first force directs the well bore tool in a first direction as the first chamber is pressurized.

6. The method of claim 5, wherein a second force directs the well bore tool in a second direction as the second chamber is pressurized, the second direction being opposite the first direction.

7. The method of claim 6, wherein the first force is greater than or equal to the second force.

8. The method of claim 6, wherein a maximum pressure in the second chamber exceeds a maximum pressure in the first chamber.

9. The method of claim 6, wherein the first force comprises a combination of a weight of a housing of the force balancing system and a pressurized force.

10. The method of claim 1, wherein fluid is allowed to flow freely through the drill string to pressurize the second chamber but is restricted when the weight of the drill string is applied to the well bore tool.

11. The method of claim 1, further comprising communicating a signal to an operator of the well bore tool that the weight of the drill string is being applied to the well bore tool.

12. The method of claim 11, wherein the signal includes a pressure increase in the drill string or a pressure decrease in the well bore tool.

13. The method of claim 1, further comprising moving a sub into engagement with a shut-off valve that is disposed in the first chamber to reduce the pressurization of the first chamber.

14. The method of claim 13, wherein the first chamber is in fluid communication with the second chamber via the shut-off valve.

15. The method of claim 13, further comprising inserting the shut-off valve into a flow bore of the sub to interrupt pressurization of the first chamber and removing the shut-off valve from the flow bore of the sub to allow pressurization of the first chamber.

16. The method of claim 13, further comprising stopping operation of the well bore tool when the shut-off valve is fully inserted into a flow bore of the sub.

17. A force balancing system for use with a well bore tool attached to a drill string, the system comprising:

a sub having an end connectable to the drill string;

a housing connectable to the well bore tool, wherein the sub is movable within the housing between an open position and a closed position;

a chamber defined between the housing and the sub, wherein pressurization of the chamber causes the weight of the drill string to be decoupled from the well bore tool; and a shut-off valve disposed in the housing, the shut-off valve configured to selectively prevent pressurization of the chamber through the sub and control the operation of the well bore tool, wherein the shut-off valve is disposed in the sub when the sub is in the closed position, and wherein the shut-off valve is not disposed in the sub when the sub is in the open position.

18. The system of claim 17, wherein the sub includes a bore in fluid communication with the chamber.

19. The system of claim 18, wherein the bore of the sub engages the shut-off valve when the sub is in the closed position, thereby preventing pressurization of the chamber.

20. The system of claim 17, further comprising a key member disposed between the sub and the housing, wherein the key member is configured to rotationally fix the sub to the housing.

21. The system of claim 20, wherein the sub includes a race formed on a side portion, wherein the key is configured to travel along the race as the sub moves between the open position and the closed position.

22. The system of claim 17, wherein the shut-off valve is configured to substantially reduce fluid flow to the chamber by way of the sub when the sub is being moved into the closed position.

23. The system of claim 17, wherein the shut-off valve includes a cylindrical housing adapted to fit within a flow bore of the sub.

24. The system of claim 17, wherein the shut-off valve is inserted into a flow bore of the sub when the sub is in the closed position.

25. The system of claim 17, wherein the shut-off valve includes an opening through which pressurized air is directed to operate the tool when the sub is in the open position.

26. The system of claim 17, wherein the shut off valve is configured to selectively prevent pressurization of the chamber through the sub and thereby stop the operation of the well bore tool.

27. An assembly attached to a work string, the assembly comprising:

a tool having a pressure chamber with an effective area; and a force balancing system disposed between the tool and the work string, the force balancing system comprising:

a sub having an end connectable to the work string;

a housing connected to the tool, wherein the sub is movable within the housing between an open position and a closed position;

a chamber defined between the housing and the sub, wherein pressurization of the chamber causes the weight of the work string to be decoupled from the tool, wherein an effective area of the chamber in the force balancing system is greater than the effective area in the pressure chamber of the tool; and a shut-off valve disposed in the housing, the shut-off valve configured to selectively prevent pressurization of the chamber through the sub and control the operation of the tool.

28. The assembly of claim 27, wherein the pressure chamber of the tool is in fluid communication with the chamber of the force balancing system via the shut-off valve.

29. The assembly of claim 27, wherein the tool is a percussion drilling tool.

30. The assembly of claim 27, wherein a flow bore of the sub engages the shut-off valve when the sub is in the closed position, thereby preventing pressurization of the chamber of the force balancing system.

31. The assembly of claim 27, further comprising a key member configured to travel along a race in the sub as the sub moves between the open position and the closed position.

32. The assembly of claim 27, wherein the shut-off valve is disposed in the sub when the sub is in the closed position, and wherein the shut-off valve is not disposed in the sub when the sub is in the open position.

33. The assembly of claim 27, wherein the shut-off valve is configured to substantially reduce fluid flow to the chamber of the force balancing system by way of the sub when the sub is being moved into the closed position.

34. The assembly of claim 27, wherein the shut-off valve includes a cylindrical housing adapted to fit within a flow bore of the sub.

35. The assembly of claim 27, wherein the shut-off valve is inserted into a flow bore of the sub when the sub is in the closed position.

36. The assembly of claim 27, wherein the shut-off valve includes an opening through which pressurized air is directed to operate the tool when the sub is in the open position.

37. An assembly attached to a work string, the assembly comprising:

a tool; and a force balancing system disposed between the tool and the work string, the force balancing system comprising:

a sub having an end connectable to the work string;

a housing connected to the tool, wherein the sub is movable within the housing between an open position and a closed position;

a chamber defined between the housing and the sub, wherein pressurization of the chamber causes the weight of the work string to be decoupled from the tool; and a shut-off valve disposed in the housing, the shut-off valve configured to selectively prevent pressurization of the chamber through the sub and control the operation of the tool, wherein the shut-off valve is disposed in the sub when the sub is in the closed position, and wherein the shut-off valve is not disposed in the sub when the sub is in the open position.

* * * * *